US006386395B1

(12) United States Patent
Lunghetti

(10) Patent No.: US 6,386,395 B1
(45) Date of Patent: May 14, 2002

(54) MULTIPLE-DOSE BOTTLE WITH DOSAGE SPOUT FOR PRODUCTS, PARTICULARLY MEDICINES

(75) Inventor: Gianni Lunghetti, Sovicille (IT)

(73) Assignee: MRP Medical Research and Promotion Establishment (LI)

( * ) Notice: Subject to any disclaimer, the term of this patent is extended or adjusted under 35 U.S.C. 154(b) by 0 days.

(21) Appl. No.: 09/601,917

(22) PCT Filed: Feb. 4, 1999

(86) PCT No.: PCT/EP99/00731

§ 371 Date: Aug. 9, 2000

§ 102(e) Date: Aug. 9, 2000

(87) PCT Pub. No.: WO99/41158

PCT Pub. Date: Aug. 19, 1999

(30) Foreign Application Priority Data

Feb. 10, 1998 (CH) ..... 0332/98

(51) Int. Cl.[7] ..... B65D 37/00
(52) U.S. Cl. ..... 222/213; 222/490; 222/494
(58) Field of Search ..... 222/212, 213, 222/490, 491, 494, 153.07, 153.06

(56) References Cited

U.S. PATENT DOCUMENTS

| | | | | | |
|---|---|---|---|---|---|
| 2,667,992 | A | * | 2/1954 | Hammond et al. | 222/490 |
| 3,618,825 | A | | 11/1971 | Clarke | 222/106 |
| 4,739,906 | A | | 4/1988 | Loturco | 222/153 |
| 4,877,624 | A | * | 10/1989 | Floyd et al. | 222/494 |
| 5,727,892 | A | | 3/1998 | Baudin | 222/494 |
| 5,743,441 | A | | 4/1998 | Baudin | 222/212 |
| 5,758,802 | A | * | 6/1998 | Wallays | 222/212 |
| 5,836,484 | A | * | 11/1998 | Gerber | 222/494 |

FOREIGN PATENT DOCUMENTS

| | | |
|---|---|---|
| CH | 528 415 | 9/1972 |
| GB | 2 048 827 | 12/1980 |

* cited by examiner

*Primary Examiner*—Philippe Derakshani
*Assistant Examiner*—Patrick Buechner
(74) *Attorney, Agent, or Firm*—Wolf, Greenfield & Sacks, P.C.

(57) ABSTRACT

A multiple-dose bottle (1) with a dosage spout (2) for products, particularly medicines, is of the deformable type and comprises a spout which comprises a nozzle (3) made of substantially rigid material and crossed by at least one aperture (5) for the outflow of the liquid, on which a cap (4) made of flexible material is fitted hermetically; the cap is provided with a dispending port (6) and compression of the bottle cause the liquid to seep between the nozzle and the cap.

19 Claims, 5 Drawing Sheets

MULTIPLE-DOSE BOTTLE WITH DOSAGE SPOUT FOR PRODUCTS, PARTICULARLY MEDICINES

CROSS-REFERENCE TO RELATED APPLICATIONS

This application is a continuation of application number PCT/EP99/00731 filed on Feb. 4, 1999.

BACKGROUND OF THE INVENTION

The present invention relates to a multiple-dose bottle with a dosage spout for products, particularly for medicines.

It is known that some products, such as for example medicines, if contained in multiple-dose bottles, use preservatives in order to avoid any likely bacterial contaminations caused by direct contact of the contained product with the surrounding air.

Currently applicable statutory provisions required, in the near future, the elimination of these preservatives from multiple-dose bottles and this disadvantageously entails the inadequacy of known kinds of bottles, which do not ensure complete asepsis of the product.

As an alternative, in order to obviate this drawback of known kinds of multiple-dose bottles, single-dose bottles which are used only once and therefore require no preservatives are used for the dosage of these products.

However, even these single-dose bottles are not free from drawbacks, including the fact that the asepsis of the product is ensured at the cost of wasting material, since the single-dose bottle is discarded after a single application of the product.

A dispensing bottle suitable for storing a sterile solution is disclosed in U.S. Pat. No. 4,739,906.

Further examples of containers provided with applicators, suitable for preserving substances, are available from U.S. Pat. No. 5,727,892, U.S. Pat. No. 5,743,441 and CH-A-528 415.

SUMMARY OF THE INVENTION

The aim of the present invention is to eliminate the above drawbacks of conventional bottles, providing a multiple-dose bottle with a dosage spout for products, particularly medicines, which allows to fully eliminate the use of preservatives which are harmful to human health, to contain an aseptic product which can be used even more than once, and to reduce the waste of material and therefore the manufacturing and packaging costs of bottles for an equal volume of contained product.

Within the scope of this technical aim, an object of the present invention is to achieve the above aim with a structure which is simple, relatively easy to provide in practice, safe in use, effective in operation and relatively cheap.

This aim and this object are both achieved by the present multiple-dose bottle with a dosage spout for products, particularly medicines, having the features set forth in the appended claims.

BRIEF DESCRIPTION OF THE DRAWINGS

Further characteristics and advantages of the present invention will become apparent from the detailed description of a preferred but not exclusive embodiment of a multiple-dose bottle with a dosage spout for products, particularly medicines, according to the invention, illustrated only by way of non-limitative example in the accompanying drawings, wherein.

DESCRIPTION OF THE PREFERRED EMBODIMENTS

Figure 1:
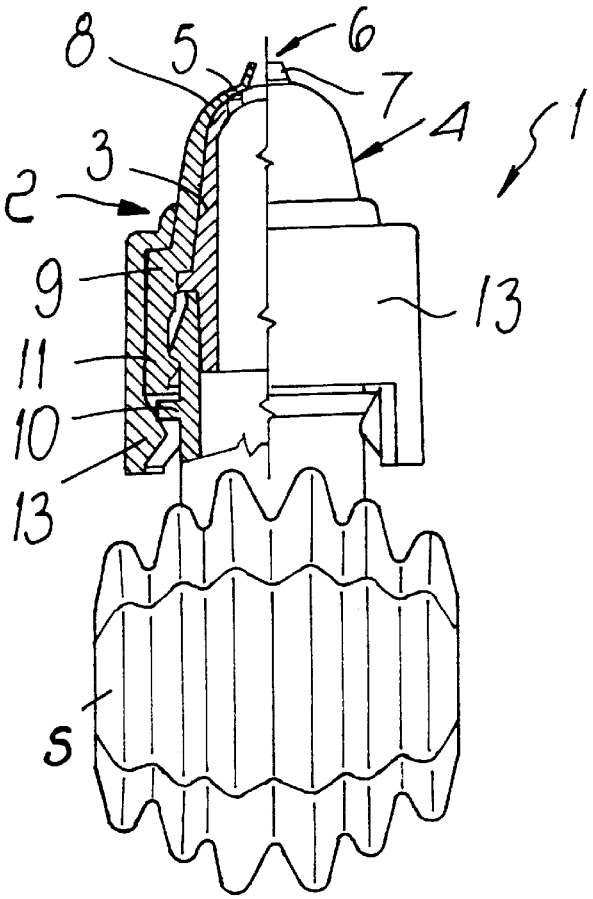
FIG. 1 is a partially sectional front view of a multiple-dose bottle with a dosage spout for products, particularly medicines, according to the invention.
Figure 3:
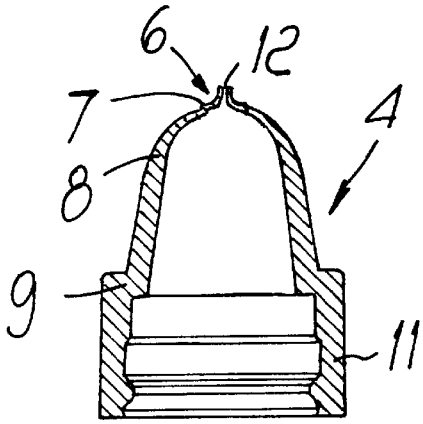
FIG. 3 is a sectional view of the cap of the bottle of FIG. 1.
Figure 4:
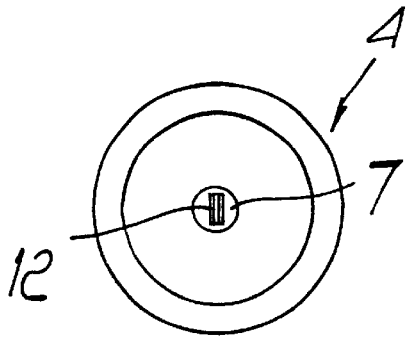
FIG. 4 is a top view of the cap of FIG. 3.
Figure 2:
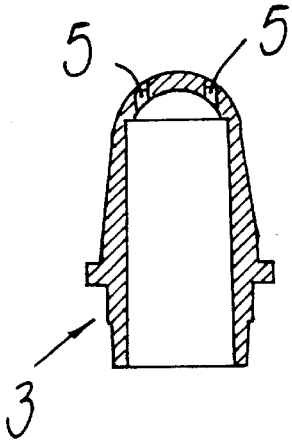
FIG. 2 is a sectional view of the nozzle of the bottle of FIG. 1.
Figure 5:
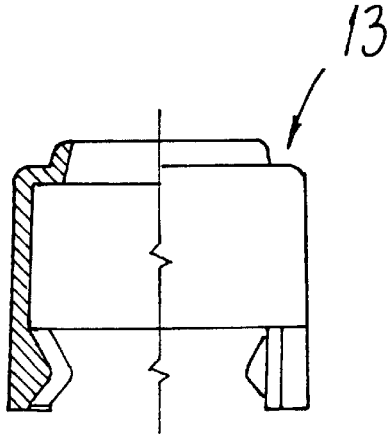
FIG. 5 is a partially sectional front view of the ring for coupling the cap and the nozzle to the bottle of FIG. 1.
Figure 6:
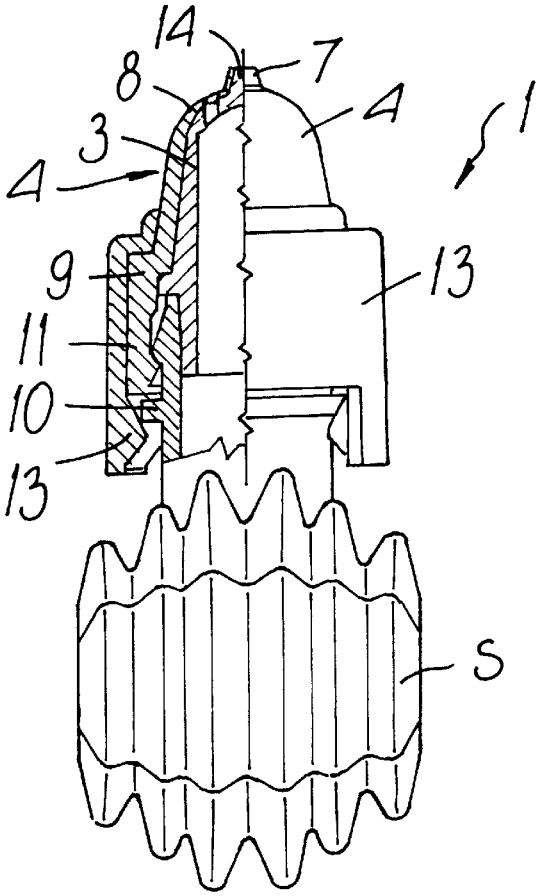
FIG. 6 is a partially sectional front view of a second possible embodiment of the bottle according to the invention.
Figure 7:
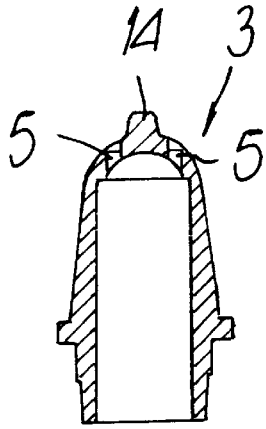
FIG. 7 is a sectional view of the nozzle of the bottle of FIG. 6.
Figure 8:
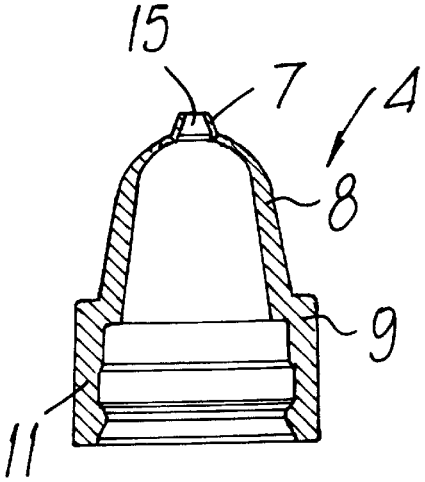
FIG. 8 is a sectional view of the cap of the bottle of FIG. 6.
Figure 9:
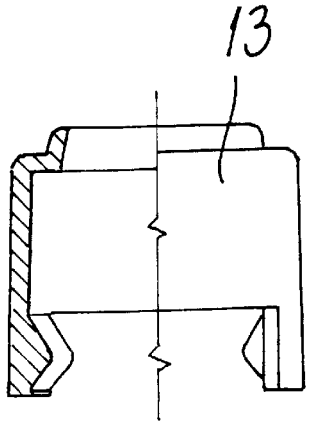
FIG. 9 is a partially sectional front view of the ring for coupling the nozzle and the cap to the bottle of FIG. 6.
Figure 11:
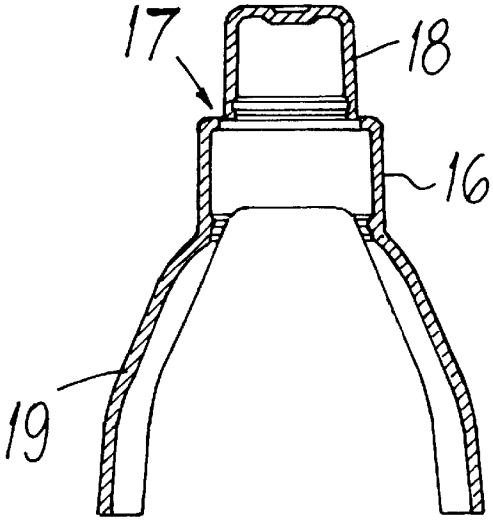
FIG. 11 is a schematic sectional view of a hood for closing the cap, provided with a ring and with a partial casing for supporting the bottle according to the invention.
Figure 12:
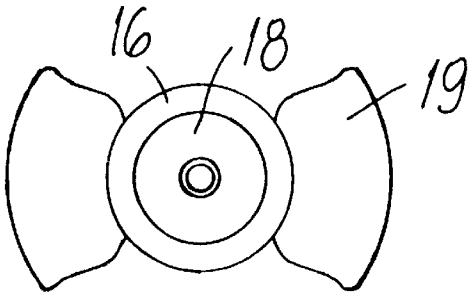
FIG. 12 is a top view of the hood of FIG. 11.

With particular reference to the above figures, the reference numeral 1 generally designates a multiple-dose bottle for products, particularly medicines, according to the invention.

The multiple-dose bottle 1 is constituted by a conventional bellows-like part S, made of a material of a deformable type, and comprises a dosage spout 2 constituted by a nozzle 3 on which a cap 4 is fitted hermetically: compression of the bellows-like part S causes the liquid to seep between the nozzle 3 and the cap 4.

The nozzle 3 is made of substantially rigid material, is ogive-shaped and is crossed by at least one aperture 5 for the outflow of the liquid; the cap 4 is made of flexible material and has a dispensing port 6 formed at an external protrusion 7 which is substantially nipple-shaped.

Advantageously, the nozzle 3 and the cap 4 are both made of a material such as plastic and/or rubber and must be sterilizable, inert and impermeable to liquids.

In its tip region 8, proximate to the protrusion 7, the cap 4 is thinner, so as to allow the liquid to seep between the aperture 5 and the port 6.

The cap 4 is thicker in the intermediate region 9, so as to ensure a better hermetic clamping against the surface of the nozzle 3; said nozzle is rigidly coupled to the mouth 10 of the bottle 1, which is in turn surmounted by the base 11 of the cap 4.

FIGS. 1 to 5 illustrate a first embodiment of the bottle 1 and some of its components in detail: the nozzle 3 has two apertures 5 and the port 6 of the cap 4 is constituted by a diametrical slit 12 on the top of the protrusion 7.

As an alternative to the slit 12, and in a manner which is fully equivalent thereto, the port 6 might also be constituted by a star-shaped arrangement of cuts or by a capillary tube formed on the protrusion 7.

Conveniently, a ring 13 is secured to the base of the cap 4 and is adapted to keep the cap 4 and the nozzle 3 rigidly coupled to the mouth 10 of the bottle 1.

FIGS. 6 to 9 illustrate a second embodiment of the bottle 1, showing its main components: in this case, the nozzle 3 is provided with two apertures 5 and is axially provided with a pin 14 which is adapted to close the port 6, which in this case is constituted by a substantially circular hole 15 of the protrusion 7.

Figure 10:
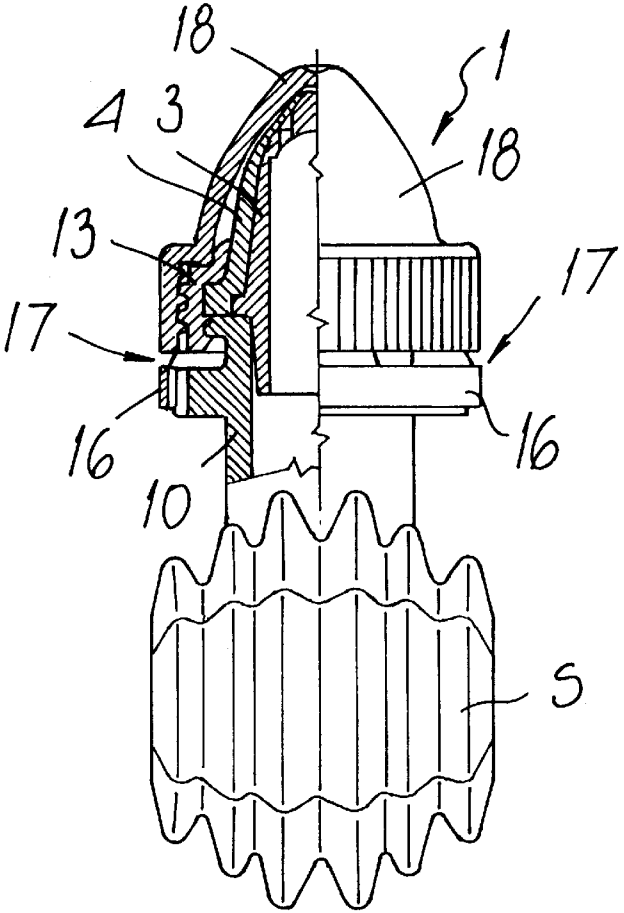
FIG. 10 is a partially sectional front view of a third possible embodiment of the bottle according to the invention.

FIG. 10 illustrates an embodiment of the bottle 1 in which a ring 16 is coupled to the mouth 10 of said bottle; said ring is connected, by conventional sealing means 17, to a hood 18 for closing the cap 4 and can be eliminated once the sealing means 17 have been removed.

Figure 13:
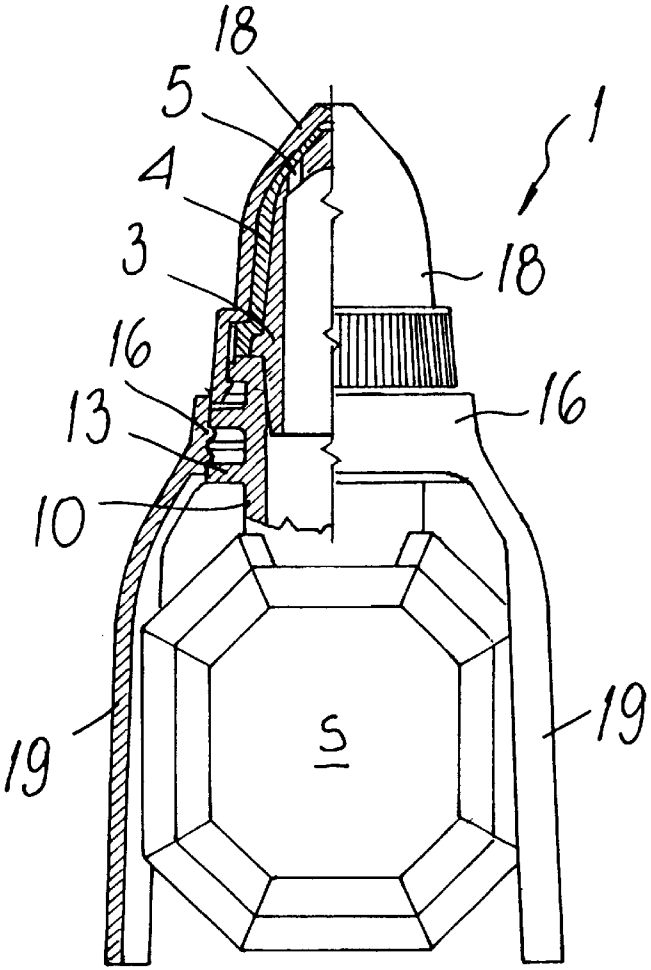
FIG. 13 is a partially sectional front view of a fourth possible embodiment of the bottle according to the invention.
Figure 15:
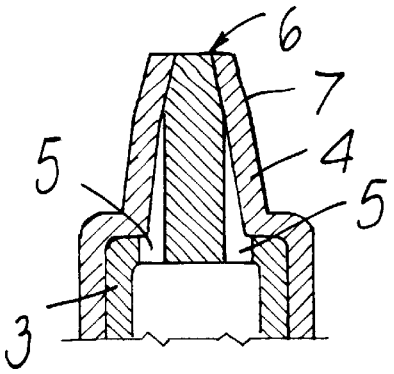
FIGS. 15, 16 and 17 are three sectional views of further possible embodiments of a cap and of a nozzle of the bottle according to the invention.
Figure 18:
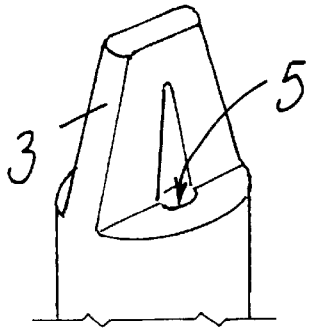
FIG. 18 is a perspective view of the nozzle of FIG. 15.
Figure 19:
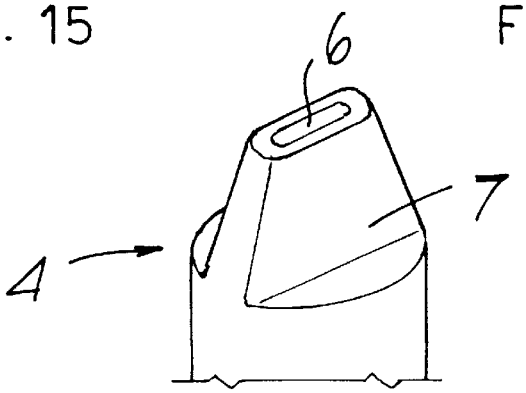
FIG. 19 is a perspective view of the cap of FIG. 15.
Figure 16:
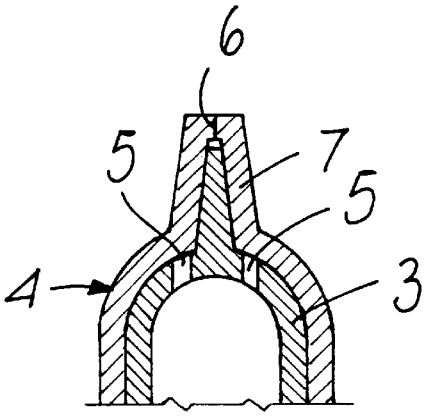
Figure 17:
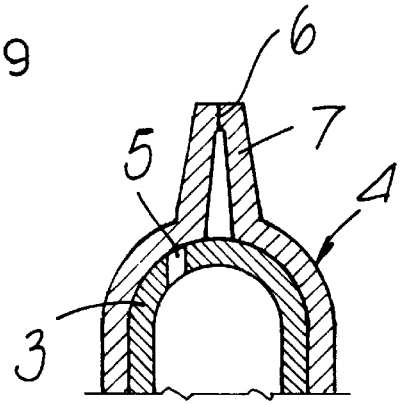
Figure 20:
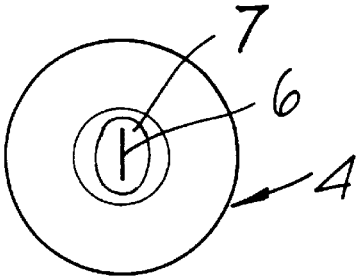
FIG. 20 is a top view of the cap of FIG. 16.
Figure 21:
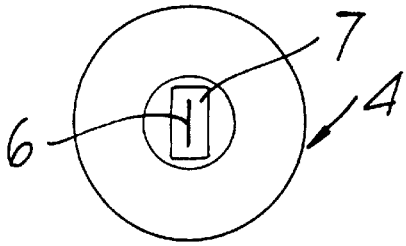
FIG. 21 is a top view of the cap of FIG. 17.

In FIG. 13, the ring 16 is rigidly coupled to the mouth 10 and protrudes downwards with a partial containment body 19 which is adapted to support the bottle 1 in vertical position.

Figure 14:
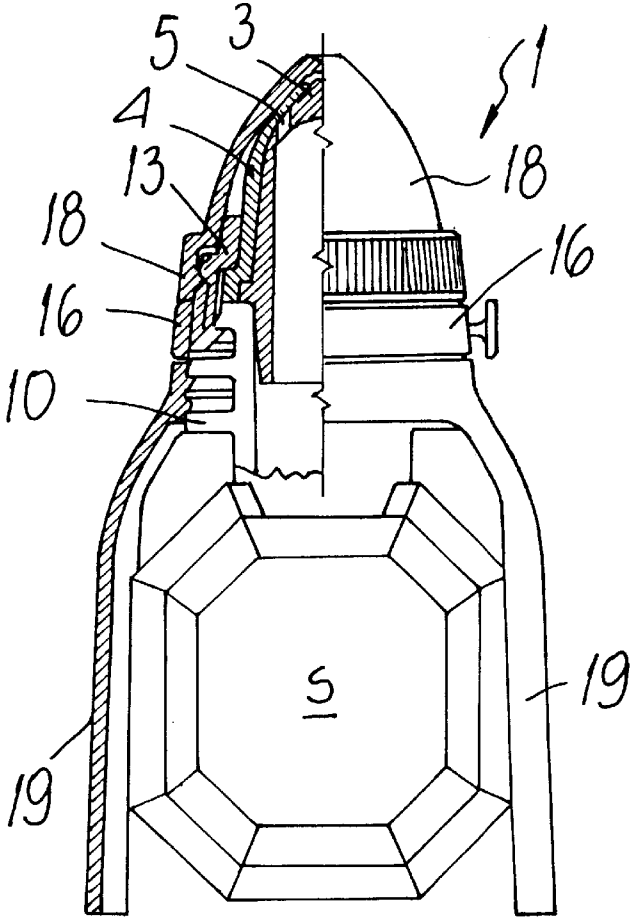
FIG. 14 is a partially sectional front view of a fifth possible embodiment of the bottle according to the invention.

In the bottle 1 of FIG. 14, the ring 16 is internally provided with conventional means for coupling to a securing ring 13 interposed between the ring and the mouth 10.

Said coupling means are generally removable and are constituted by a portion which is coupled, by pressing or by interlocking, to the ring 13 or by a threaded portion which can be screwed on a correspondingly threaded portion of the ring 13.

FIGS. 15 to 21 are views of some additional possible embodiments of the nozzle 3 and of the cap 4 which are fully equivalent to one another.

The use of the bottle according to the invention is as follows: when inactive, the cap 4 adheres perfectly to the nozzle 3, preventing any possible external contamination and any possible outflow of liquid contained in the bottle 1.

During use, by applying an adapted pressure to the bellows-like part S, the end portion 8 of the cap 4 lifts off the nozzle 3 so as to allow the liquid to seep from at least one aperture 5 to the dispensing port 6.

Once the pressure of the bellows-like part S has ceased, the portion 8 of the cap rests again in close contact with the nozzle 3, thus closing the apertures 5 for the outflow of the liquid and simultaneously preventing the inflow of external contaminants.

The invention thus conceived is susceptible of numerous modifications and variations, all of which are within the scope of the inventive concept.

Furthermore all the details may be replaced with other technically equivalent ones.

In practice, the materials used, as well as the shapes and the dimensions, may be any according to the requirements without thereby abandoning the scope of the protection of the appended claims.

What is claimed is:

1. Multiple-dose bottle with dosage spout for liquid medicine products, said bottle being deformable and said spout comprising: a nozzle sealingly connected to said bottle at a base part thereof and having an external surface ending with a top part, said nozzle being made of substantially rigid material and being crossed, at said surface, between said base and top parts thereof, by at least one aperture for the outflow of the liquid product; and a cap, made of flexible material, which covers completely said nozzle and is provided at a region thereof corresponding to said top part of the nozzle with a dispensing port, wherein said flexible cap fits elastically, all over said external surface of the nozzle, at least at a region including said at least one aperture and said nozzle top part, so as to form normally closed valve seals both at said at least one aperture and at said dispensing port, said valve seals being actuatable in an open condition upon compression of the bottle, with said cap swelling off said external surface, first at said at least one aperture and thereafter at said dispensing port, to allow the liquid product to seep out between the nozzle and the cap to said dispensing port, and again in the normally closed condition when bottle compression is discontinued, with a seal at said at least one aperture being restored first and the seal at the dispensing port being restored at a second moment, wherein said cap is thinner at its end region in order to allow the liquid to seep, while it is thicker in its intermediate region in order to secure itself hermetically against the surface of the nozzle.

2. Bottle according to claim 1, wherein said port is constituted by a substantially circular hole.

3. Bottle according to claim 1, wherein said cap is made of a rubber material which can be sterilized and is inert and impermeable to liquids.

4. Bottle according to claim 1, wherein said cap is made of a plastic material, which can be sterilized and is inert and impermeable to liquids.

5. Bottle according to claim 1, wherein said nozzle is substantially ogive-shaped.

6. Bottle according to claim 5, wherein said nozzle is made of a plastic material which can be sterilized and is inert and impermeable to liquids.

7. Bottle according to claim 1, wherein the port of said cap is substantially axial and is formed at an external protrusion which is substantially nipple-shaped.

8. Bottle according to claim 7, wherein said nozzle is axially provided with a pin for closing said protrusion.

9. Bottle according to claim 7, wherein said port is constituted by a diametrical slit of said protrusion.

10. Bottle according to claim 7, wherein said port is constituted by a star-shaped arrangement of cuts in said protrusion.

11. Bottle according to claim 7, wherein said port is constituted by a capillary tube of said protrusion.

12. Bottle according to claims 1, wherein said nozzle is rigidly coupled to the mouth of said bottle and a base of said cap surmounts said mouth.

13. Bottle according to claim 12, comprising a ring which is rigidly coupled to the mouth of the bottle and is connected, by removable sealing means, to a hood for closing said cap.

14. Bottle according to claim 12, further comprising an annular ring element which is internally provided with removable means for coupling to said ring.

15. Bottle according to claim 14, wherein said annular ring element extends downwards with a partial containment body for supporting said bottle in vertical position.

16. Bottle according to claim 14, wherein said removable coupling means are constituted by a threaded portion which can be screwed on a corresponding threaded portion of said ring.

17. Bottle according to claim 14, wherein said removable coupling means are constituted by a portion which is pressure-coupled to said ring.

18. Bottle according to claim 14, wherein said removable coupling means are constituted by a portion which is coupled by interlocking to said ring.

19. Multiple-dose bottle with dosage spout for liquid medicine products, said bottle being deformable and said spout comprising: a nozzle sealingly connected to said bottle at a base part thereof and having an external surface ending with a top part, said nozzle being made of substantially rigid material and being crossed, at said surface, between said base and top parts thereof, by at least one aperture for the outflow of the liquid product; and a cap, made of flexible material, which covers completely said nozzle and is provided at a region thereof corresponding to said top part of the nozzle with a dispensing port, wherein said flexible cap fits elastically, all over said external surface of the nozzle, at least at a region including said at least one aperture and said nozzle top part, so as to form normally closed valve seals both at said at least one aperture and at said dispensing port, said valve seals being actuatable in an open condition upon compression of the bottle, with said cap swelling off said external surface, first at said at least one aperture and thereafter at said dispensing port, to allow the liquid product to seep out between the nozzle and the cap to said dispensing port, and again in the normally closed condition when bottle compression is discontinued, with the seal at said at least one aperture being restored first and the seal at the dispensing port being restored at a second moment, wherein said nozzle is rigidly coupled to the mouth of said bottle and a base of said cap surmounts said mouth, said bottle comprising a ring for rigidly coupling the cap and the nozzle to said bottle which is secured to the base of said cap.

* * * * *